United States Patent [19]

Goldblatt et al.

[11] 3,977,288

[45] Aug. 31, 1976

[54] SAW CHAIN WITH FREE END CHISEL RAKERS AND BIFURCATED CUTTERS

[75] Inventors: Lawrence Goldblatt, Hamilton; Werner Weiss, Burlington; Vitomir Mance, Rockwood, all of Canada

[73] Assignee: Sabre Saw Chain Limited, Burlington, Canada

[22] Filed: May 21, 1975

[21] Appl. No.: 579,577

[52] U.S. Cl. ..... 83/833; 83/834

[51] Int. Cl.[2] ..... B27B 33/14

[58] Field of Search ..... 83/833, 834, 832, 830

[56] References Cited

UNITED STATES PATENTS

| | | | |
|---|---|---|---|
| 2,986,180 | 5/1961 | Irgens | 83/834 |
| 3,167,100 | 1/1965 | Consoletti | 83/834 |
| 3,745,870 | 7/1973 | Lemery | 83/833 |

*Primary Examiner*—Donald R. Schran
*Attorney, Agent, or Firm*—Schuyler, Birch, Swindler, McKie & Beckett

[57] ABSTRACT

A saw chain for a chain saw with kerf sidewall cutting, free end chisel raker teeth having positive cutting edge rake angles and with bifurcated cutters formed from paired, laterally opposed cutting elements wherein the free end chisel corners of the raker teeth project laterally outwardly beyond the bifurcated cutter forming elements so that the combined cutting width of two mirror image raker teeth is greater than the cutting width of the bifurcated cutters; the height of the bifurcated cutters being generally equal to or less than the height of the raker teeth; the cutting edges of each raker tooth and each bifurcated cutter being disposed rearwardly of the rearmost pivot point of the link which bears it, and the outer surfaces of the shank portions of the raker teeth and the outer surfaces of the bifurcated cutter forming elements being formed to engage the upper edges of the immediately following side links to lock each cutter bearing link against rearing back more than a specified amount.

12 Claims, 6 Drawing Figures

SAW CHAIN WITH FREE END CHISEL RAKERS AND BIFURCATED CUTTERS

This invention relates to saw chains for power driven chain saws. More particularly the invention relates to a new cutter tooth configuration for saw chains for power driven chain saws.

The most commonly utilized type of saw chain for power driven chain saws is the chipper or semichisel type of chain illustrated in Cox, U.S. Pat. No. 2,508,784, wherein C-shaped cutters and integral depth gauges are formed on certain side links of a three-strand chain; successive cutters along the length of the chain being mirror images of each other disposed on opposite sides of the chain. In cutting timber with a saw chain of the Cox type, the kerf sidewall is cut by the curved shank portions of the C-shaped cutter. Modern saw chains of this type tend to be relatively fast cutting, however their cutter action is exceedingly rough. This results in somewhat erratic cutting and a considerable amount of vibration which not only contributes to operator fatigue and discomfort but also poses safety hazards. Also it is impossible to cut the roots of a tree stump with such chain because even the briefest contact between the cutters and granular material in the soil almost immediately destroys the highly sharpened cutting edges of the cutters and in a moment renders the chain unfit for sawing wood. Moreover, although somewhat easier to sharpen than the scratcher type chains which preceded it, the Cox type chain is nevertheless comparatively difficult to maintain since the cutting edge is sharpened by hollow grinding with a round file.

In attempting to develop smoother saw chains, configurations have been proposed in which the kerf sidewall is cut by the free end of an L-shaped cutter. Since chips of wood cut by such a chain are completely severed by a single cutter, this type of chain is theoretically a very smooth cutting chain. However, such chains have a very pronounced tendency to quickly accumulate chips in front of the individual cutters until the chain becomes clogged or fouled to the degree that it is no longer an effective cutting tool.

Saw chains have also been proposed comprising various sequences of bifurcated cutters formed from pairs of laterally opposed side cutting elements and raker cutters. An example of such chain is disclosed in Lemery, U.S. Pat. No. 3,745,870. In cutting timber with this type of chain, the kerf sidewalls are slit by the opposed side cutting elements of the bifurcated cutters and then the intervening wood fibers are removed by the following raker teeth. Consequently, the cutting width of the bifurcated cutters is greater than the cutter width of the raker cutters. Likewise, in this type of chain, the height of the bifurcated cutters, i.e. the maximum distance which the cutting edge projects radially outwardly from the saw bar, is greater than the height of the cutting edge of the raker cutters. Such saw chains with bifurcated slitter teeth and raker teeth have a comparatively smooth cutting action, however they cut much more slowly than conventional semichisel type chain, and they show pronounced tendency to bind in the kerf particularly on soft wood thereby imposing excessive power requirements on the saw and causing problems with overheating. Moreover, saw chains of this type cannot acceptably execute rip cuts or cuts at an angle to the wood grain.

OBJECTS OF THE INVENTION

Accordingly it is an object of the present invention to provide a saw chain which is both fast and smooth cutting.

It is also an object of the invention to provide a saw chain which avoids the problems of clogging and fouling with wood chips.

It is a further object of the invention to provide a saw chain which has an excellent ability to retain a sharp cutting edge, that is to say which has a good "stay-sharp" characteristic as it is termed in the art.

It is a further object of the invention to provide a saw chain which, when dull, can be readily sharpened with a flat file by even the most unskilled personnel so that it is very easy to maintain.

Another object of the invention is to provide a saw chain which can be used to cut tree roots without immediately rendering the chain unfit for further sawing of wood.

Additional objects of the invention will become apparent from a consideration of the following specification.

SUMMARY OF THE INVENTION

The foregoing objects are achieved by providing a saw chain for a chain saw comprising a series of center links and pairs of side links pivotally joined to form a chain; certain of the links bearing kerf sidewall cutting raker teeth having shank and toe portions; said toe portions having leading edges with positive cutting edge rake angles and ending in kerf sidewall cutting, free end chisel corners; successive raker teeth along said chain being mirror images of each other; other of said links bearing paired, laterally opposed cutting elements forming bifurcated cutters; the free chisel corners of the raker toe portions projecting laterally outwardly beyond the fiburcated cutter forming elements so that the combined cutting width of two mirror image raker teeth is at least about 0.010 inches greater than the cutting width of the bifurcated cutters, and the height of the bifurcated cutter forming elements lying in the range from generally equal to about 0.010 inches less than the height of the raker teeth.

In a preferred embodiment of the invention the raker bearing links are center links; the cutting edge of each raker cutter is disposed generally even with or rearwardly of the rearmost pivot point of the raker bearing center link and the other surface of the shank portion of each raker tooth is formed to engage the upper edge of one of the immediately following side links to lock each raker bearing center link against rearing back more than a specified amount lying in the range from about 1.5° to about 5° with respect to the immediately following pair of side links.

In a further preferred form of the invention each pair of laterally opposed bifurcated cutter forming elements is borne by a pair of mirror image link elements disposed laterally contiguous to each other to form a single bifurcated cutter bearing center link; the cutter edges of each bifurcated cutter are disposed generally even with or rearwardly of the rearmost pivot point of the bifurcated cutter bearing center link, and the outer surfaces of the bifurcated cutter forming elements are formed to engage the upper edges of the immediately following side links to lock each bifurcated cutter bearing center link against rearing back more than a specified amount lying in the range from about 5° to about 12° with respect to the immediately following pair of side links.

BRIEF DESCRIPTION OF THE DRAWINGS

Particulars of the invention will be described hereinafter with reference to the appended drawings wherein.

DETAILED DESCRIPTION OF THE PREFERRED EMBODIMENTS

Figure 1:
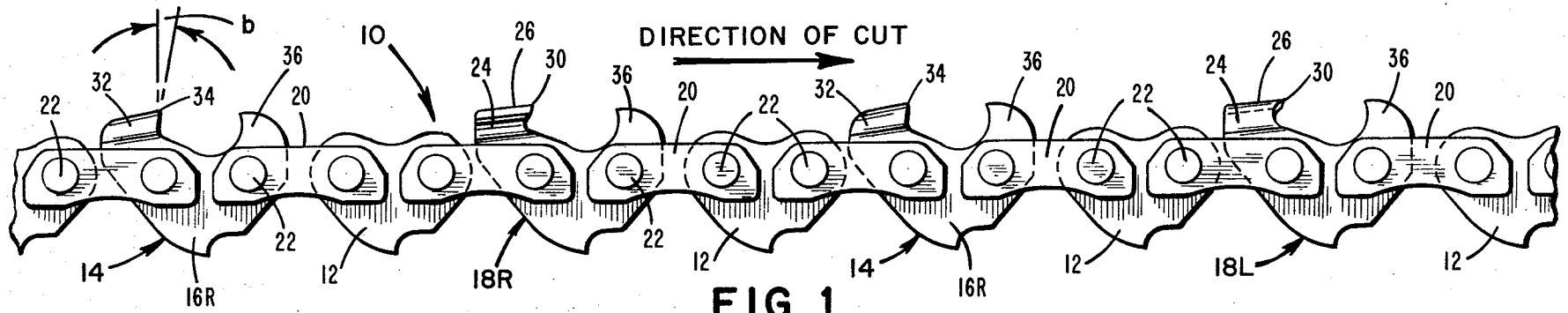
FIG. 1 is a side view of a saw chain formed according to the present invention.
Figure 2:
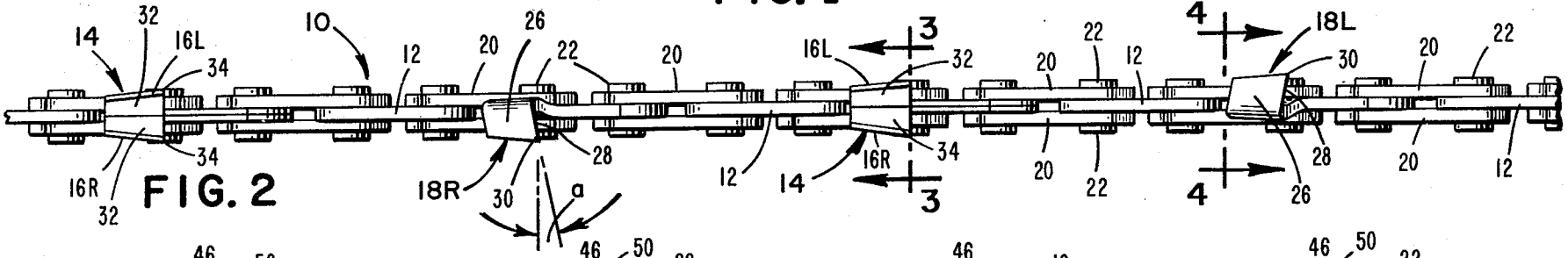
FIG. 2 is a plan view of the saw chain of FIG. 1.

FIGS. 1 and 2 show a saw chain generally designated by reference numeral 10 comprising a series of center links 12, 14 and 18 and a series of pairs of side links 20. The chain is designed to travel in the direction indicated by the reference arrow at the top of the drawings. As used herein, all references to the forward direction are intended to refer to the direction of chain travel as indicated by the aforesaid arrow. All references to the rearward direction are intended to refer to the direction opposite to the direction of chain travel. As used herein, all references to the "upward" direction refer to the direction radially outwardly from a saw bar upon which the chain of the invention is resting.

In chain 10, the forward end of each center link is pivotally joined to the rearward ends of a pair of side links 20 by means of rivets 22 which pass through appropriate rivet holes in the link bodies. Likewise the forward ends of each pair of side links are pivotally joined to the rearward end of a preceding center link. In this way a continuous loop of saw chain is assembled. All of the side links 20 on both sides of chain 10 are identical, flat, non-cutting links.

The center links of chain 10 are of three types. The first type is a non-cutting spacer link designated by reference numeral 12. The second type of center link is a raker bearing cutter link designated by reference numeral 18. Two forms of raker bearing link 18 are provided: a right-hand bearing form 18 R and a left-hand form designated 18 L. Links 18 R and 18 L are identical except for the fact that they are allochiral, i.e. mirror images of each other. The third type of center link is a bifurcated cutter bearing link 14 comprising two mirror image link elements 16 R and 16 L disposed laterally contiguous to each other to form a single center link. The thickness of link elements 16 R and 16 L is approximately one-half the thickness of center links 12 and 18. All of the center links of chain 10 are provided with downwardly extending drive sprocket engaging portions adapted to ride in the groove of a saw bar.

Each link 18 bears a raker cutter tooth comprising an upwardly extending shank portion 24 laterally offset slightly out of the plane of the link body. Each raker cutter tooth further comprises a toe portion 26 which extends laterally across the median plane of the chain to a point where it projects beyond the ends of rivets 22. Preferably the toe portion is of generally uniform thickness. The forward part of toe portion 26 is sharpened to provide a cutting edge 28 having a positive rake angle, designated by reference letter a, lying in the range from about 0° to about 10°, most preferably about 5°. As used herein, the term positive angle is intended to include an angle of 0°. The positive rake angle of cutting edge 28 results in formation of a free end chisel cutting corner 30 at the extremity of toe portion 26. In cutting timber with the chain of the present invention, the sidewall of the kerf is cut by the free end chisel cutting corners 30 of the raker tooth bearing center links 18.

The raker cutters are formed at the rearward ends of links 18 with the forwardmost projection of the cutting edge of each raker cutter in the direction of chain travel at most generally even with the rearmost pivot point of the raker bearing center link. In other words, the longitudinal position of free end cutting corner 30 which is formed at the forward extremity of cutting edge 28 is either generally even with the axis of the rear rivet which passes through the link bearing the cutter in question or it is behind the rivet axis. In the preferred embodiment illustrated in FIGS. 1 and 2, the free end chisel corner 30 and the entire cutting edge 28 are positioned slightly rearward of the axis of the rear rivet passing through each link 18. Of course sharpening of the raker teeth by filing them back with a flat file will result in the chisel corner and cutting edge being relocated further to the rear of the rear rivet.

As noted hereinabove, center link 14 comprises two link elements 16 R and 16 L each of which bears an upwardly and outwardly extending cutting element. Cutting elements 32 carried by link elements 16 R and 16 L are paired and laterally opposed so that they form a bifurcated cutter or U-shaped cutter. The upper extremities of cutting elements 32 are formed with flat cutting edges 34, each of which may typically be from about 0.010 inches to about 0.025 inches wide. Like the raker cutting edges on links 18, the forwardmost projection of cutting edges 34 of each bifurcated cutter in the direction of chain travel is at most generally even with the rearmost pivot point of the bifurcated cutter bearing link, i.e. cutting edges 34 are disposed either generally even with the axis of the rear rivet which passes through each link 14 or rearwardly thereof. In the preferred embodiment illustrated in FIGS. 1 and 2, the cutting edges 34 are slightly rearward of the axes of the rear rivets extending through links 14. It is understood, however that sharpening of the cutters will reduce the cutters thereby progressively moving the position of the cutting edges 34 along the length of the chain even further to the rear of the rivet axes.

The forward face of each cutting element 32 of each bifurcated cutter or U-shaped cutter is inclined slightly forwardly from the body of link 14 to the cutting edge 34 so that each bifurcated cutter has a positive rake angle, identified in FIG. 1 by reference letter *b* lying in the range from about 0° to about 10°; most preferably about 5°. Again, the term "positive angle" is intended to include an angle of 0°. By virture of the aforesaid positive angle, cutting edges 34 constitute the forwardmost projection of each bifurcated cutter forming element 32.

In saw chain 10 each cutter bearing link 14 and 18 is provided at its forward end with an integral depth gauge 36 which limits the depth of cut taken by the cutter teeth. As used herein, the term "height of a cutter" refers to the maximum projection of the cutter radially outwardly from a saw bar upon which the chain is resting. Likewise the height of a depth gauge is the maximum projection of the depth gauge radially outwardly from a saw bar upon which the chain is resting. In order for the cutter teeth to engage the wood being cut, the height of the cutting edge of each cutter should be somewhat greater than the height of the associated depth gauge. In the art, this difference in height between the cutting edge of a cutter and the associated depth gauge is referred to as the "depth gauge setting." According to the present invention, it is preferred that all of the raker bearing links and bifurcated cutter bearing links have a uniform depth gauge setting lying in the range from about 0.020 inches to about 0.040 inches, preferably about 0.030 inches.

In saw chain 10, the various center links are arranged in a definite sequence. Beginning with the forward end of the chain illustrated in FIGS. 1 and 2, this sequence is as follows: non-cutting connecting link 12, left-hand raker tooth bearing link 18L, non-cutting connecting link 12, bifurcated cutter bearing link 14, non-cutting connecting link 12, right-hand raker tooth bearing link 18 R, non-cutting connecting link 12 and a second bifurcated cutter bearing link 14. The foregoing sequence is repeated until the desired length of chain is assembled. In the foregoing sequence, successive raker tooth bearing links are allochiral, i.e. mirror images of each other; successive cutter bearing links alternate between a raker tooth bearing link and a bifurcated cutter bearing link, and a non-cutting connecting link is interposed between successive cutter bearing links. The foregoing center link sequence is the preferred link sequence for a ⅜ pitch general purpose saw chain. However, it is recognized that variations in the link sequence may be desirable for special purposes.

Figure 3:
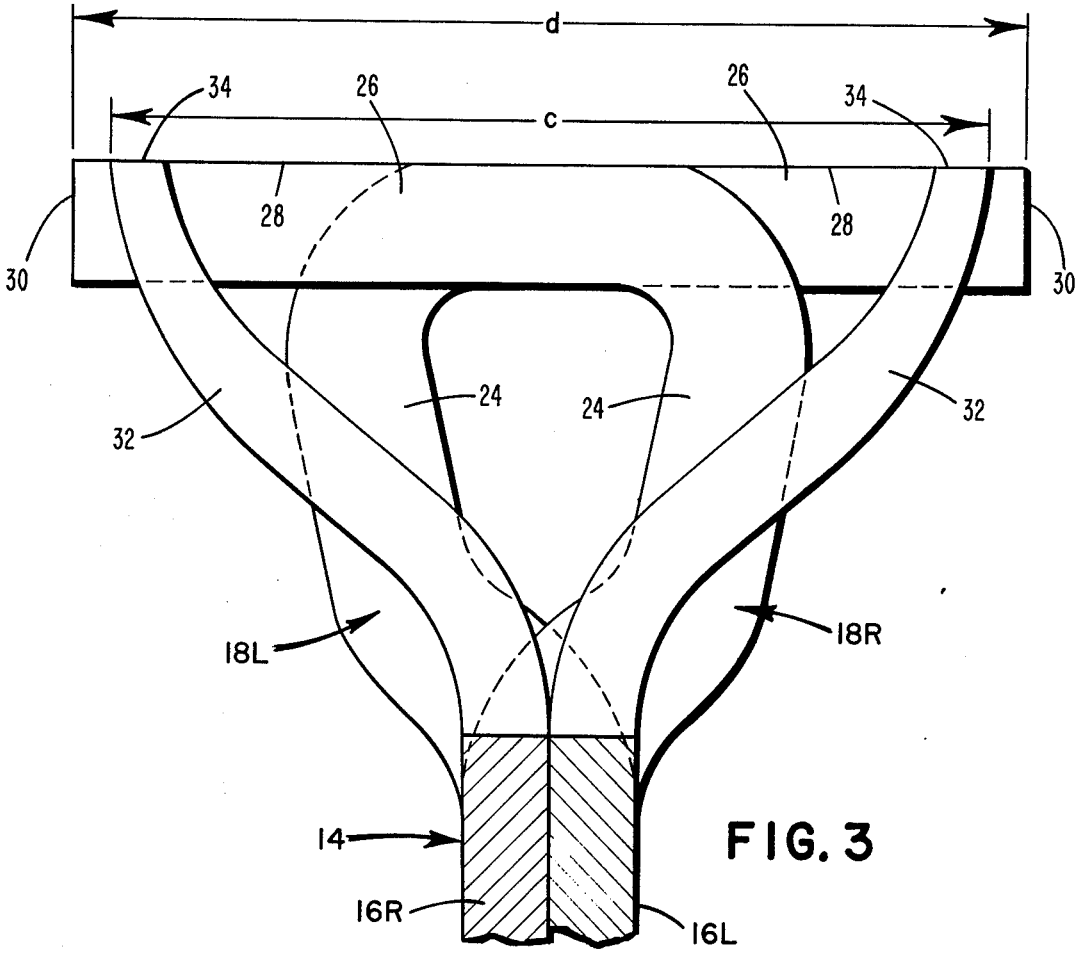
FIG. 3 is a sectional view taken along line 3—3 of FIG. 2.

FIG. 3 is an enlarged sectional view of saw chain 10 taken along line 3—3 of FIG. 2 from which the integral depth gauges 36 have been omitted in order to more clearly illustrate the configurational relationship between the free end chisel raker teeth and the bifurcated cutters. FIG. 3 also clearly shows how center links 14 are formed from two mirror image link elements 16 R and 16 L bearing upwardly and outwardly extending, generally wing-shaped bifurcated cutter forming elements 32 ending in flat cutting edges 34. The distance between the lateral extremities of cutter forming elements 32 is the cutting width of the bifurcated cutter and is identified in the drawing by reference letter *c*.

FIG. 3 also clearly shows how each raker bearing link 18 R, 18 L is formed with a laterally offset shank portion 24 and a toe portion 26 which extends from the upper extremity of shank portion 24 across the median plane of the chain to a point laterally beyond the extremity of the bifurcated cutter forming element 32 where toe portion 26 ends in a free end chisel cutting edge 30. As previously noted, when cutting timber with the saw chain of the present invention, cutting edges 30 cut the sidewalls of the kerf. The combined cutting width of a right hand raker tooth and a left hand raker tooth is identified in the drawing by reference letter *d* and is greater than the cutting width *c* of the bifurcated cutters. In a ⅜ pitch saw chain, the combined cutting width of a right hand raker and a left hand raker may range from a minimum of about 0.010 inches to a maximum of about 0.100 inches greater than the cutting width of the bifurcated cutters. Preferably the cutting width difference lies in the range from about 0.020 to about 0.030 inches. A successful prototype chain has been tested in which the combined cutting width of a right hand raker and a left hand raker is about 0.320 inches and the cutting width of the bifurcated cutters was about 0.290 inches. It is recognized that adaptation of the configuration of the present invention to other sizes of chain by one skilled in the art may require some adjustment of the most preferred dimensional ranges.

According to the present invention, the height of the bifurcated cutters may range from generally equal to the height of the raker cutters, as illustrated in FIG. 3, to about 0.010 inches less than the height of the raker cutters.

Figure 4:
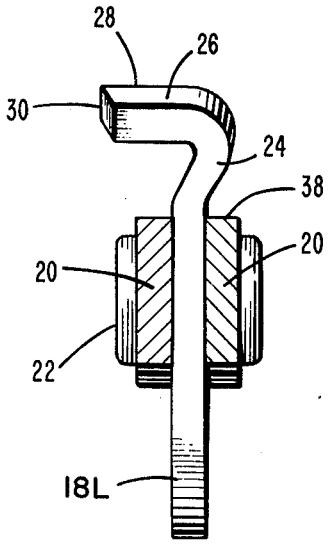
FIG. 4 is a sectional view taken along line 4—4 of FIG. 2.

FIG. 4 is a sectional view of saw chain 10 taken along line 4—4 of FIG. 2 illustrating the configurational relationship between the laterally offset shank 24 of a raker cutter and the upper surface 38 of an immediately following side link 20. The importance of this configurational relationship will be further explained hereinafter with reference to FIG. 6.

Figure 5:
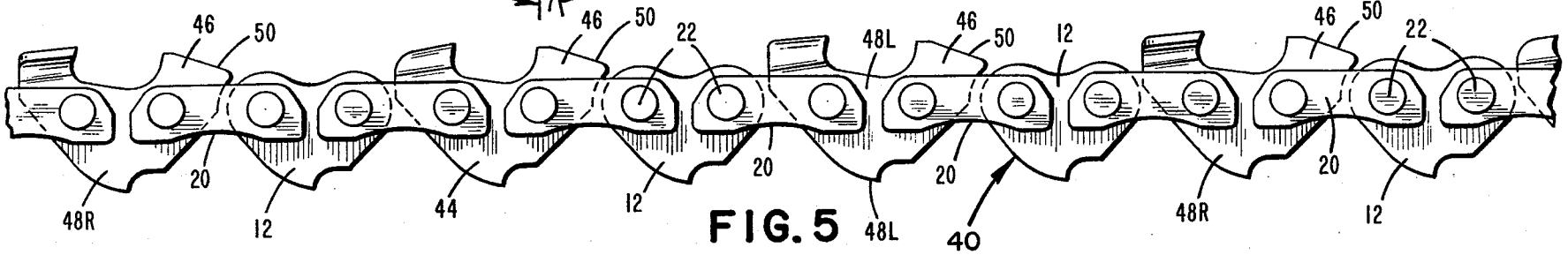
FIG. 5 is a side view of an alternate embodiment of saw chain formed according to the present invention.

FIG. 5 shows an alternate saw chain embodiment 40 according to the present invention which utilizes an alternate preferred center link sequence. Beginning at the forward end of chain 40 the alternate preferred link sequence is as follows: non-cutting connecting link 12, right-hand raker tooth bearing link 48 R, non-cutting connecting link 12, left-hand raker tooth bearing link 48 L, non-cutting connecting link 12, and bifurcated cutter bearing link 44. Again, the sequence is repeated until the desired length of chain 40 has been assembled. The alternate preferred sequence of chain 40 differs from the preferred sequence of saw chain 10 in that only one bifurcated cutter bearing link is provided for each allochiral pair of raker tooth bearing links. The alternate preferred link sequence of saw chain 40 is the preferred link sequence for a 0.404 pitch professional saw chain.

FIG. 5 also illustrates an alternate embodiment of integral depth gauge designated by reference numeral 46. Depth gauges 46 are formed with upwardly and rearwardly inclined leading edges 50 which extend from generally adjacent the top surface of the immediately preceding center link to the top of the depth gauge. The upwardly and rearwardly inclined leading edge 50 of depth gauges 46 acts as a camming surface to lift obstructions smoothly up over the leading edge of the depth gauge thereby helping to prevent dangerous "kickback" of the chain saw and giving chain 40 a safety chain character.

Figure 6:
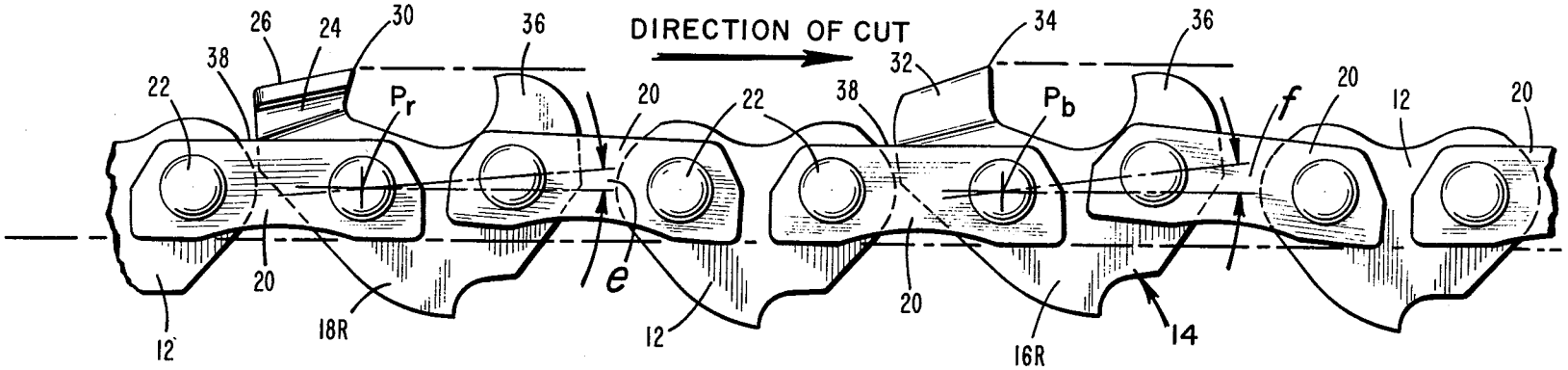
FIG. 6 is an enlarged side view of the saw chain of FIG. 1 which illustrates the interaction of the cutter bearing links with the following side links.

FIG. 6 is an enlarged side view of a saw chain 10 corresponding generally to FIG. 1 which illustrates the interaction between the cutter bearing center links and the following side links. When the cutter teeth of chain 10 engage the wood during cutting, a reaction force is exerted on the cutters opposite to the direction of chain travel. This reaction force causes each cutter bearing link to tend to pivot backwardly with respect to the immediately following pair of side links about its rearmost pivot point, i.e. the axis of the rear rivet. In the art, this backward pivoting of a cutting bearing link due to the reaction forces from cutting is termed "rearing back". Thus, as illustrated in FIG. 6, raker tooth bearing link 18 R tends to pivot in a counterclockwise direction about the point designated by reference letter $P_R$. Likewise bifurcated cutter bearing link 14 tends to pivot in a counterclockwise direction about the point designated by reference letter $P_B$. This pivoting action decreases the effective height of the cutting edges of the cutter teeth and increases the effective height of the depth gauges. If the pivoting action is unchecked, it will actually cause the depth gauges to assume greater effective height than the cutting edges thereby disengaging the cutters from the wood. As soon as the cutter disengages from the wood, the reaction force acting on the cutter ceases, and the tension of the chain causes the cutter bearing link to rotate forward until the cutting edge again engages the wood, whereupon the reaction force again causes the cutter bearing link to rear back until the cutting edge disengages from the wood. Thus, in the absence of measures to limit the rearing back of the chain, it would oscillate between a cutting state and a non-cutting state thereby giving rise to a manifestly erratic cutting action.

Accordingly, in the saw chain of the present invention, means are provided to lock each cutter bearing link against rearing back more than a specified amount in order to prevent the depth gauges from assuming a greater effective height than the cutting edges of the cutters thereby maintaining constant engagement between the cutters and the wood. In the preferred embodiment of the chain of the present invention, such means comprise the laterally offset shank portions of the raker teeth and the upwardly and outwardly extending bifurcated cutter forming elements being formed to engage the upper edge 38 of the immediately following side link 20. FIG. 4 shows how the outer surface of laterally offset shank portion overhangs the upper surface 38 of side link 20, so that as raker tooth bearing link 18 L rears back, shank portion 24 will engage surface 38 to lock the link against further backward rotation.

In FIG. 6, the permissible amount which raker bearing tooth link 18 R can rear back before locking against further rotation is shown by reference angle *e*. Angle *e* may range from about 1.5° to about 5°, preferably 2° or less.

Likewise, in FIG. 6, the premissible amount of rearing back before bifurcated cutter bearing link 14 locks against further backward rotation is designated by reference angle *f*. Ordinarily, somewhat greater amounts of rearing back can be tolerated for the bifurcated cutter bearing links. Thus, angle *f* may range from about 5° to about 12°, preferably about 7°.

The saw chain of the present invention may be made by subjecting highly alloyed carbon steel stock strip to punching, stamping, cropping and forming in a progressive die as disclosed in U.S. Pat. No. 3,837,241 to produce the individual links and link elements. The chain parts are then heat treated and the cutters are chrome plated and ground to form sharpened cutting edges. The individual links are then assembled in the proper sequence and riveted together to form an articulated chain.

The chain of the invention is used in the same manner as prior art saw chains in that an endless loop of chain is mounted on a saw bar of a chain saw with the lower margins of the side links riding on the side rails of the bar and the drive sprocket engaging portions of the center links disposed in the groove of the bar except for a small number of links which at any given time are actually in engagement with the drive sprocket of the saw. The saw is provided with a suitable prime mover such as a gasoline engine or electric motor which causes the chain to move around the saw bar by driving the sprocket through suitable means such as a centrifugal clutch. The operator then positions the saw in the well-known manner so that the rapidly moving chain contacts the wood which is to be cut and holds the saw in contact with the wood until the cut is complete.

Since the combined cutting width of the right hand and left hand raker teeth is greater than the cutting width of the bifurcated cutters in the chain of the invention and since the maximum height of the bifurcated cutters is generally equal to the height of the raker teeth cutting edges, it is apparent that in the chain of the present invention, the principal cutting is done by the raker teeth. This is a distinct contrast to the cutting action of prior art bifurcated cutter containing chains where the principal cutting is done by the bifurcated cutters which are both higher and wider than the raker teeth. In the saw chain of the present invention, the bifurcated cutters serve in some way, which at present is not completely understood, to clear the chips from the chain thereby preventing clogging and fouling.

Significantly, while prior art bifurcated cutter saw chains have a much slower cutting action than conventional semichisel chains, the saw chain of the present invention has a fast cutting speed comparable to that of conventional semichisel chains as evidenced by the following test.

TEST 1

A length of ⅜ pitch, 0.050 gauge saw chain according to the present invention and a length of convention semichisel type chain of the same pitch and gauge were each mounted on a 3.5 HP chain saw fitted with a 20 inch saw bar and a 7 tooth drive sprocket and used to cut a series of sections through a 12 inch by 12 inch oak log. Five values of the number of seconds required for each cut were recorded for each chain in initially new condition, after cutting 100 square feet and after cutting 200 square feet, and the values were averaged. The results are tabulated below:

| 12 in. × 12 in. Oak Logs | Cutting Time in Seconds | | | |
|---|---|---|---|---|
| | Conventional Chain | | Chain of Invention | |
| Initially New Condition | No. 1 | 25.4 | No. 1 | 25.8 |
| | No. 2 | 23.0 | No. 2 | 24.0 |
| | No. 3 | 23.2 | No. 3 | 24.7 |
| | No. 4 | 23.4 | No. 4 | 25.0 |
| | No. 5 | 22.8 | No. 5 | 25.0 |
| | Average | 23.6 | Average | 24.9 |
| After 100 Sq. Ft. | No. 1 | 23.3 | No. 1 | 25.2 |
| | No. 2 | 22.4 | No. 2 | 29.0 |
| | No. 3 | 22.7 | No. 3 | 26.0 |
| | No. 4 | 22.6 | No. 4 | 26.2 |
| | No. 5 | 22.6 | No. 5 | 26.0 |
| | Average | 22.7 | Average | 26.5 |
| After 200 Sq. Ft. | No. 1 | 23.2 | No. 1 | 23.0 |
| | No. 2 | 24.3 | No. 2 | 23.0 |
| | No. 3 | 24.2 | No. 3 | 23.5 |
| | No. 4 | 24.4 | No. 4 | 25.5 |
| | No. 5 | 23.8 | No. 5 | 24.8 |
| | Average | 24.0 | Average | 24.0 |

The results clearly establish that the chain of the present invention cuts at rates comparable to conventional semichisel chains.

Moreover, in sharp contrast to conventional bifurcated cutter saw chains, the saw chain of the present invention has an excellent cutting action on rip cuts and angle cuts.

The saw chain of the present invention has a smooth, balanced, essentially vibration-free cutting action and does not tend to wander in the kerf and/or bind like prior art saw chains. The smooth cutting action of the saw chain of the present invention is readily apparent from a comparison of the surfaces cut by the chain of the present invention and a conventional semichisel chain; the surface cut by the chain of the present invention being much, much smoother.

Notably, the saw chain of the present invention can be readily sharpened by even unskilled persons merely by filing back the leading edge of the cutters with a flat file. The chain of the present invention is significantly easier to sharpen than conventional prior art chains much must be sharpened with a round file. This is a very important point as studies have shown that ease of sharpening is a critical factor in market acceptance.

The chain of the present invention has an excellent "stay-sharp" characteristic. Sharpening the cutting edges with a flat file gives the chain of the present invention a somewhat blunter cutting edge than prior art chains which were in effect hollow ground with a round file. Consequently, the cutting edges of the chain of the present invention are much less susceptible to damage than the highly sharpened cutting edges of prior art chains as evidenced by the fact that the saw chain of the present invention can even be used to cut roots on a tree stump without immediately destroying the effectiveness of the chain for further cutting of wood. Of course, no chain can remain totally undamaged by contact with the soil around tree roots, but the resistance of the chain of the present invention to damage is much greater than that of conventional prior art chains.

The foregoing embodiments of saw chain have been described solely for purposes of exemplifying the invention, and are not intended to limit the scope thereof. It is understood that modifications may be made in the structure of the foregoing embodiments without departing from the spirit of the invention. For example, the bifurcated cutter forming elements could be mounted on a pair of opposed side links, or the rearing back of the cutter bearing links could be controlled by forming the rear surface of each cutter bearing link so that it engages the front edge of the following center link, or the chain might be modified to a straddle-type chain, or the raker teeth might be mounted on side links. Accordingly, the scope of the invention is to be limited solely by the scope of the appended claims.

We claim:

1. A saw chain for a chain saw comprising a series of center links and pairs of side links pivotally joined to form a chain; certain of said links bearing kerf sidewall cutting raker teeth having shank and toe portions; said toe portions having leading edges with positive cutting edge rake angles; said toe portions ending in kerf sidewall cutting, free end chisel corners; successive raker teeth along said chain being mirror images of each other; other of said links bearing paired, laterally opposed cutting elements forming bifurcated cutters; said free end chisel corners of said raker toe portions projecting laterally outwardly beyond said bifurcated cutter forming elements; the combined cutting width of two mirror image raker teeth being about 0.010 inches or more greater than the cutting width of said bifurcated cutters; the height of said bifurcated cutter forming elements lying in the range from generally equal to about 0.010 inches less than the height of said raker teeth.

2. A saw chain as recited in claim 1 wherein the raker bearing links are center links; the forwardmost projection of the cutting edge of each raker cutter in the direction of chain travel is at most generally even with the rearmost pivot point of the raker bearing center link, and said chain further comprising means to lock each raker bearing center link against rearing back more than a specified amount lying in the range from about 1.5° to about 5° with respect to the immediately following pair of side links.

3. A saw chain as recited in claim 2 wherein said means for locking raker bearing link against rearing back comprises the outer surface of the shank portion of the raker tooth being formed to engage the upper edge of one of the immediately following side links when said specified amount of rearing back has been achieved.

4. A saw chain as recited in claim 1 wherein each pair of laterally opposed bifurcated cutter forming elements is borne by a pair of mirror image link elements disposed laterally contiguous to each other to form a single bifurcated cutter bearing center link of said chain.

5. A saw chain as recited in claim 4 wherein the forwardmost projection of the cutting edges of each bifurcated cutter in the direction of chain travel is at most generally even with the rearmost pivot point of the bifurcated cutter bearing center link; said chain further comprising means to lock each bifurcated cutter bearing center link against rearing back more than a specified amount lying in the range from about 5° to about 12° with respect to the immediately following pair of side links.

6. A saw chain as recited in claim 5 wherein said means for locking each bifurcated cutter bearing center link against rearing back comprises the outer surfaces of the bifurcated cutter forming elements being formed to engage the upper edges of the immediately following side links when said specified amount of rearing back has been achieved.

7. A saw chain as recited in claim 1 wherein successive cutter bearing links in said chain comprise in sequence: a first raker bearing center link, a first bifurcated cutter bearing center link, a second raker bearing center link, said second raker bearing center link being a mirror image of said first raker bearing center link, and a second bifurcated cutter bearing center link; said sequence being repeated along the length of the chain.

8. A saw chain as recited in claim 1 wherein successive cutter bearing links in said chain comprise in sequence: a first raker bearing center link, a second raker bearing center link; said second raker bearing center link being a mirror image of said first raker bearing center link, and a bifurcated cutter bearing center link; said sequence being repeated along the length of the chain.

9. A saw chain as recited in claim 1 further comprising an integral depth gauge formed at the forward end of each cutter bearing link.

10. A saw chain as recited in claim 9 wherein each depth gauge has an upwardly and rearwardly inclined leading edge extending from generally adjacent the top surface of the immediately preceding center link to the top of the depth gauge.

11. A saw chain as recited in claim 2 wherein the entire cutting edge of each raker cutter is positioned rearward of the rearmost pivot point of the raker bearing center link.

12. A saw chain as recited in claim 5 wherein the cutting edges of each bifurcated cutter are positioned entirely rearward of the rearmost pivot point of the bifurcated cutter bearing center link.

* * * * *